US008148962B2

(12) United States Patent
Elran

(10) Patent No.: US 8,148,962 B2
(45) Date of Patent: Apr. 3, 2012

(54) TRANSIENT LOAD VOLTAGE REGULATOR

(75) Inventor: Tomer Shaul Elran, Petah Tikva (IL)

(73) Assignee: SanDisk IL Ltd., Kfar Saba (IL)

( * ) Notice: Subject to any disclaimer, the term of this patent is extended or adjusted under 35 U.S.C. 154(b) by 400 days.

(21) Appl. No.: 12/464,301

(22) Filed: May 12, 2009

(65) Prior Publication Data

US 2010/0289465 A1 Nov. 18, 2010

(51) Int. Cl.
*G05F 1/00* (2006.01)

(52) U.S. Cl. ..... 323/281

(58) Field of Classification Search ..... 323/267–280, 323/311–316, 281; 327/538, 540, 541
See application file for complete search history.

(56) References Cited

U.S. PATENT DOCUMENTS

| | | | | |
|---|---|---|---|---|
| 4,446,383 | A | 5/1984 | Concannon | |
| 4,498,058 | A | 2/1985 | Benrud | |
| 4,536,699 | A | 8/1985 | Baker | |
| 5,162,668 | A | 11/1992 | Chen | |
| 5,202,587 | A | 4/1993 | McLaury | |
| 5,296,800 | A | 3/1994 | Bjorkman | |
| 5,428,316 | A | 6/1995 | Molnar | |
| 5,512,814 | A | 4/1996 | Allman | |
| 5,519,656 | A | 5/1996 | Maccarrone | |
| 5,631,606 | A | 5/1997 | Tran | |
| 5,675,241 | A | 10/1997 | Teggatz | |
| 5,739,681 | A | 4/1998 | Allman | |
| 5,864,227 | A * | 1/1999 | Borden et al. | 323/280 |
| 5,867,015 | A | 2/1999 | Corsi | |
| 5,905,399 | A | 5/1999 | Bosnyak | |
| 5,909,109 | A * | 6/1999 | Phillips | 323/277 |
| 5,982,226 | A * | 11/1999 | Rincon-Mora | 323/273 |
| 6,058,488 | A | 5/2000 | Eckhardt | |
| 6,101,118 | A | 8/2000 | Mulatti | |
| 6,118,266 | A | 9/2000 | Manohar | |
| 6,140,805 | A | 10/2000 | Kaneko | |

(Continued)

FOREIGN PATENT DOCUMENTS

EP 0602163 B1 1/1997

(Continued)

OTHER PUBLICATIONS

Hazucha et al., "Area-Efficient Linear Regulator With Ultra-Fast Load Regulation", IEEE Journal of Solid State Circuits, vol. 40. No. 4, Apr. 2005. pp. 933-940.

(Continued)

*Primary Examiner* — Jue Zhang
(74) *Attorney, Agent, or Firm* — Patterson Thuente Christensen Pedersen, P.A.

(57) ABSTRACT

Systems and methods providing for improved voltage regulation of a supply voltage for an integrated circuit are described herein. The voltage regulator circuit includes a feedback circuit coupled to a first current path and adapted to maintain a gate voltage of a feedback transistor substantially constant. A pass device is coupled to a second current path and adapted to receive a signal with a magnitude based on first and second currents supplied by first and second current sources to the second current path. In an embodiment, the first current is a substantially constant current and the second current has a magnitude based on a magnitude of the voltage at the feedback transistor gate and a magnitude of a voltage at an output of the voltage regulator circuit coupled to the pass device.

20 Claims, 8 Drawing Sheets

U.S. PATENT DOCUMENTS

| | | | | |
|---|---|---|---|---|
| 6,175,221 | B1 | 1/2001 | Kalpakjian | |
| 6,188,211 | B1 | 2/2001 | Rincon-Mora | |
| 6,201,375 | B1 * | 3/2001 | Larson et al. | 323/277 |
| 6,285,246 | B1 * | 9/2001 | Basu | 323/316 |
| 6,285,614 | B1 | 9/2001 | Mulatti | |
| 6,304,131 | B1 | 10/2001 | Huggins | |
| 6,331,766 | B1 | 12/2001 | Kalpakjian | |
| 6,573,694 | B2 | 6/2003 | Pulkin | |
| 6,586,916 | B2 | 7/2003 | Kalpakjian | |
| 6,621,675 | B2 | 9/2003 | Ingino | |
| 6,653,891 | B1 | 11/2003 | Hazucha | |
| 6,734,716 | B2 | 5/2004 | Amick | |
| 6,809,504 | B2 | 10/2004 | Tang | |
| 6,809,557 | B2 | 10/2004 | Gauthier | |
| 6,828,850 | B2 | 12/2004 | LeChevalier | |
| 6,847,198 | B2 | 1/2005 | Kalpakjian | |
| 6,873,503 | B2 | 3/2005 | Amick | |
| 6,914,476 | B2 | 7/2005 | Ingino | |
| 6,924,674 | B2 | 8/2005 | Jalaleddine | |
| 6,975,494 | B2 | 12/2005 | Tang | |
| 7,091,709 | B2 | 8/2006 | Suzuki | |
| 7,095,272 | B2 * | 8/2006 | Morishita | 323/316 |
| 7,132,880 | B2 | 11/2006 | Ingino | |
| 7,151,410 | B2 | 12/2006 | Franck | |
| 7,173,482 | B2 | 2/2007 | Lobb | |
| 7,218,082 | B2 * | 5/2007 | Walter et al. | 323/273 |
| 7,319,314 | B1 | 1/2008 | Maheshwari | |
| 7,323,853 | B2 | 1/2008 | Tang | |
| 7,352,210 | B2 * | 4/2008 | Luo | 323/311 |
| 7,368,994 | B2 | 5/2008 | Franck | |
| 7,394,306 | B2 | 7/2008 | Chen | |
| 7,446,515 | B2 | 11/2008 | Wang | |
| 7,482,791 | B2 | 1/2009 | Stoichita | |
| 2002/0005710 | A1 | 1/2002 | Kalpakjian | |
| 2002/0149398 | A1 | 10/2002 | Ingino | |
| 2003/0001550 | A1 | 1/2003 | Pulkin | |
| 2003/0137341 | A1 | 7/2003 | LeChevalier | |
| 2003/0155964 | A1 | 8/2003 | Gauthier | |
| 2003/0197492 | A1 | 10/2003 | Kalpakjian | |
| 2004/0056700 | A1 | 3/2004 | Amick | |
| 2004/0057169 | A1 | 3/2004 | Amick | |
| 2004/0095701 | A1 | 5/2004 | Ingino | |
| 2005/0088205 | A1 | 4/2005 | Jalaleddine | |
| 2005/0134383 | A1 | 6/2005 | Franck | |
| 2005/0225380 | A1 | 10/2005 | Ingino | |
| 2006/0220730 | A1 | 10/2006 | Lobb | |
| 2007/0109052 | A1 | 5/2007 | Franck | |
| 2007/0164810 | A1 | 7/2007 | Chen | |
| 2007/0268008 | A1 | 11/2007 | Gicquel et al. | |
| 2008/0174289 | A1 * | 7/2008 | Gurcan et al. | 323/280 |
| 2008/0180080 | A1 | 7/2008 | Terry | |
| 2009/0033298 | A1 | 2/2009 | Kleveland | |

FOREIGN PATENT DOCUMENTS

| | | | |
|---|---|---|---|
| EP | 0497591 | B1 | 4/1997 |
| EP | 0783796 | | 7/1997 |
| EP | 0661717 | B1 | 3/2000 |
| EP | 0957421 | B1 | 9/2003 |
| EP | 0851332 | B1 | 2/2004 |
| EP | 1229419 | A3 | 8/2004 |
| EP | 1622067 | B1 | 2/2008 |
| WO | WO 9305572 | | 3/1993 |
| WO | WO 9705696 | | 2/1997 |
| WO | WO 2004/027995 | A3 | 4/2004 |

OTHER PUBLICATIONS

Hazucha et al., "An Area-Efficient, Integrated, Linear Regulator with Ultra-Fast Load Regulation", Symposium on VLSI Circuits Digest of Technical Papers. 2004. pp. 218-221.

Notification of Transmittal of the International Search Report and the Written Opinion of the International Searching Authority, or the Declaration (PCT Rule 44.1) Mailing Date of Sep. 3, 2010.

International Search Report for International Application No. PCT/IL 10/00377 Dated May 12, 2010.

Written Opinion of the International Searching Authority for International Application No. PCT/IL 10/00377 Dated May 12, 2010.

* cited by examiner

TRANSIENT LOAD VOLTAGE REGULATOR

FIELD OF THE INVENTION

The invention relates generally to integrated circuits and, more particularly, to electrical circuits adapted to stabilize a source voltage in light of a varying output load.

BACKGROUND OF THE INVENTION

Power usage is a primary concern for many consumer electronics devices. As a solution, many known devices are adapted to selectively operate certain circuitry so that battery resources are utilized as sparingly as possible. For example, a mobile phone may turn off camera circuitry while a user is on a call. To do so, the camera circuitry may be electrically isolated from the battery so it ceases to draw current from the battery.

This approach creates problems in the design of the integrated circuits (ICs) that operate electronic devices, because the selective turning on and off of circuits referenced to a power supply causes variations in a supply voltage. For most electrical circuits to operate properly, they must be referenced to a stable supply voltage.

Many solutions have been proposed for voltage regulators to stabilize a power supply voltage under varying load conditions. One known approach is a source follower (also known as a common-drain amplifier or voltage follower) such as an NMOS source follower. A classic NMOS source follower includes an N-Channel transistor (known as a pass transistor). A drain of the pass transistor is coupled to a load to supply power. The voltage across the load is fed back to a differential amplifier that supplies a control voltage at the gate of the pass transistor.

A source follower solution operates relatively well to stabilize a supply voltage for circuits that operate at frequencies such as 1 Mhz and above. However, a source follower typically operates poorly for circuits operating at lower frequencies such as below 100 kHz. Because many integrated circuits require a regulated supply voltage at all frequency ranges, a source follower may be undesirable in many applications.

In addition, to effectively regulate a power supply, a source follower typically requires a relatively large output capacitor to ensure enough charge is available to compensate for changes in the load powered by the regulator. Such a capacitor often takes up a large amount of space on an integrate circuit or must be off-chip connected to a capacitor in an IC package.

Other approaches to power regulation, such as discussed in U.S. Pat. No. 6,653,891 to Hazucha et al., incorporate some form of additional feedback loop to improve upon an ability of a source follower voltage regulator to regulate voltage and current supplied to a load in light of varying load conditions. For example, U.S. Pat. No. 7,319,314 to Maheshwari et al. discloses the use of a dual difference amplifier stage feedback circuit and a voltage replicator to better stabilize a supply voltage. Similarly, U.S. Pat. No. 7,446,515 to Wang, U.S. Pat. No. 6,809,504 to Tang et al., U.S. Pat. No. 6,975,494 to Tang et al., U.S. Pat. No. 6,188,211 to Runcon-Mora et al., and U.S. Pat. No. 5,867,015 to Corsi et al. describe other various dual stage regulators. Still other approaches, such as U.S. Pat. Pub. No. 2009/0033298 to Kleveland, combine analog feedback circuitry with a digital controller and one or more sense circuits to provide additional feedback in light of varying load conditions.

A common drawback of the above-mentioned approaches is that each involves a relatively complex configuration of transistors and other circuit components, which not only requires significant space in an integrated circuit, but also increases design and IC implementation costs. And, for many known solutions, additional space on an IC, a circuit board, or in an IC package is required due to a need for a relatively large capacitor. Further, although the above-mentioned regulators may provide improved stability at a range of frequencies, they do so at the cost of relatively large current draw of the regulator itself, which is inefficient for purposes of preserving battery life.

Thus, a need exists in IC technology to provide an improved variable load voltage regulator for integrated circuits that has improved stability at both low and high frequencies of circuit operation. Also, a need exists to provide such a voltage regulator that does not require a large capacitor. Furthermore, a need exists for a simple, inexpensive, and easy to design voltage regulator for variable load integrated circuits.

SUMMARY OF THE INVENTION

In various embodiments, a voltage regulator circuit integrated in an integrated circuit (IC) and adapted to provide a voltage from a power supply to a load under varying load conditions is described herein. The voltage regulator circuit includes an input adapted to receive a voltage from the power supply and an output adapted to be coupled to the load. The regulator further includes a feedback circuit coupled to a first current path. The feedback circuit includes a feedback transistor and is constructed to maintain a voltage at a gate of the feedback transistor substantially constant.

The voltage regulator circuit further includes a first current supply circuit constructed to supply to a second current path a first current that is substantially constant. The regulator further includes a second current supply circuit coupled to the first current supply circuit, the gate of the feedback transistor, and the output of the voltage regulator circuit. The second current supply circuit is constructed to supply a second current to the second current path with a magnitude based on the voltage at the gate of the feedback transistor and a voltage at the output of the voltage regulator circuit.

A pass device that includes a gate coupled to the second current path is adapted to receive a signal with a magnitude based on a magnitude of a current of the second current path and supply a load current to the load via the output of the voltage regulator circuit with a magnitude based on a magnitude of the signal. In an embodiment, the second current source is adapted to, via the pass device, cause an increase in a magnitude of the load current supplied to the output if a voltage at the output decreases and cause a decrease in magnitude of the load current supplied to the output if a voltage at the output increases. The feedback circuit, the first current supply circuit, the second current supply circuit, and the pass device are integrated in an integrated circuit and referenced to the input of the voltage regulator circuit.

In various embodiments, a voltage regulator circuit integrated in an integrated circuit (IC) adapted to provide a voltage from a power supply to a load under varying load conditions is described herein. The regulator includes an input adapted to receive a voltage from the power supply and an output adapted to be coupled to the load. The regulator further includes a first current path referenced to the input, and a feedback means for maintaining a voltage at a gate of a feedback transistor substantially constant. The regulator also includes a first current supply means for supplying to a second current path referenced to said input a first current that is substantially constant and a second current supply means coupled to the first current supply means, the gate of the feedback transistor, and the output of the voltage regulator circuit for receiving a first voltage reference and a second voltage reference and for supplying a second current to the second current path with a magnitude based on the first voltage reference and the second voltage reference.

The regulator also includes means for supplying current to the load for receiving a signal with a magnitude based on a magnitude of the first current and the second current and for supplying a load current to the load via said output of the voltage regulator circuit with a magnitude based on a magnitude of the signal. In an embodiment, the first current supply means, the second current supply means and the means for supplying current to the load are arranged such that, if a voltage at the load decreases, a magnitude of said load current supplied to the load is increased and, if a voltage at the load increases, a magnitude of the load current supplied to the load is decreased. The feedback means, the first current supply means, the second current supply means, and the means for supplying current to the load are integrated in an integrated circuit.

In other embodiments according to various aspects of the invention described herein, methods of regulating a supply voltage for selectively operable load circuitry of an integrated circuit are described. In one embodiment, a method includes receiving, from a power supply, a power supply voltage and supplying, to a first current path referenced to the power supply voltage, a master current. The master current is received at a feedback circuit. A voltage at a gate of the feedback transistor is maintained substantially constant via the feedback circuit.

A first current with a substantially constant magnitude is supplied to a second current path coupled to a pass transistor. A second current is also supplied to the second current path. The second current has a magnitude based on the voltage at the gate of the feedback transistor and a voltage at the variable load. A control signal based on a magnitude of the second current and a magnitude of the first current is received at the gate of the pass transistor. A load current with a magnitude based on the control signal is supplied to the load via the pass transistor such that when a voltage across the variable load increases, a magnitude of the load current is reduced, and when a voltage across the variable load decreases, a magnitude of the load current is increased.

In other various embodiments, a method of regulating a supply voltage for selectively operable load circuitry of an integrated circuit is described. The method includes generating, at a first current path integrated in the integrated circuit, a substantially constant master current. The method further includes supplying to a second current path via a first current source integrated in the integrated circuit, a first current and supplying, via a second current source integrated in the integrated circuit and coupled to the second current path, a second current with a magnitude based in part on a voltage at said variable load. The method also includes receiving, from the second current path, a control signal at a pass transistor integrated in the integrated circuit, wherein the control signal has a magnitude based on the first current and the second current. In addition, the method includes supplying, to the load circuitry via the pass transistor, a load current in response to the control current, wherein a magnitude of the first current and a magnitude of the second current are at least in part dependent on a magnitude of the master current.

Advantageously, embodiments of the invention described herein provide for improved regulation of a supply voltage for integrated circuits. The systems and methods for voltage regulation described herein provide for a simple, easy to design voltage regulator that utilizes a minimum of components and takes up a minimum amount of space on an IC while being capable of regulating a supply voltage for circuits operating at both low and high frequencies. The voltage regulator described herein is further capable of regulating a supply voltage while minimizing an amount of current drawn by the voltage regulator circuit, thus maximizing battery life. In addition, the voltage regulator described herein allows for effective power supply voltage regulation without a dependence on a larger output capacitor arrangement.

BRIEF DESCRIPTION OF THE DRAWINGS

The invention may be more completely understood in consideration of the following detailed description of various embodiments of the invention in connection with the accompanying drawings, in which.

Figure 1:
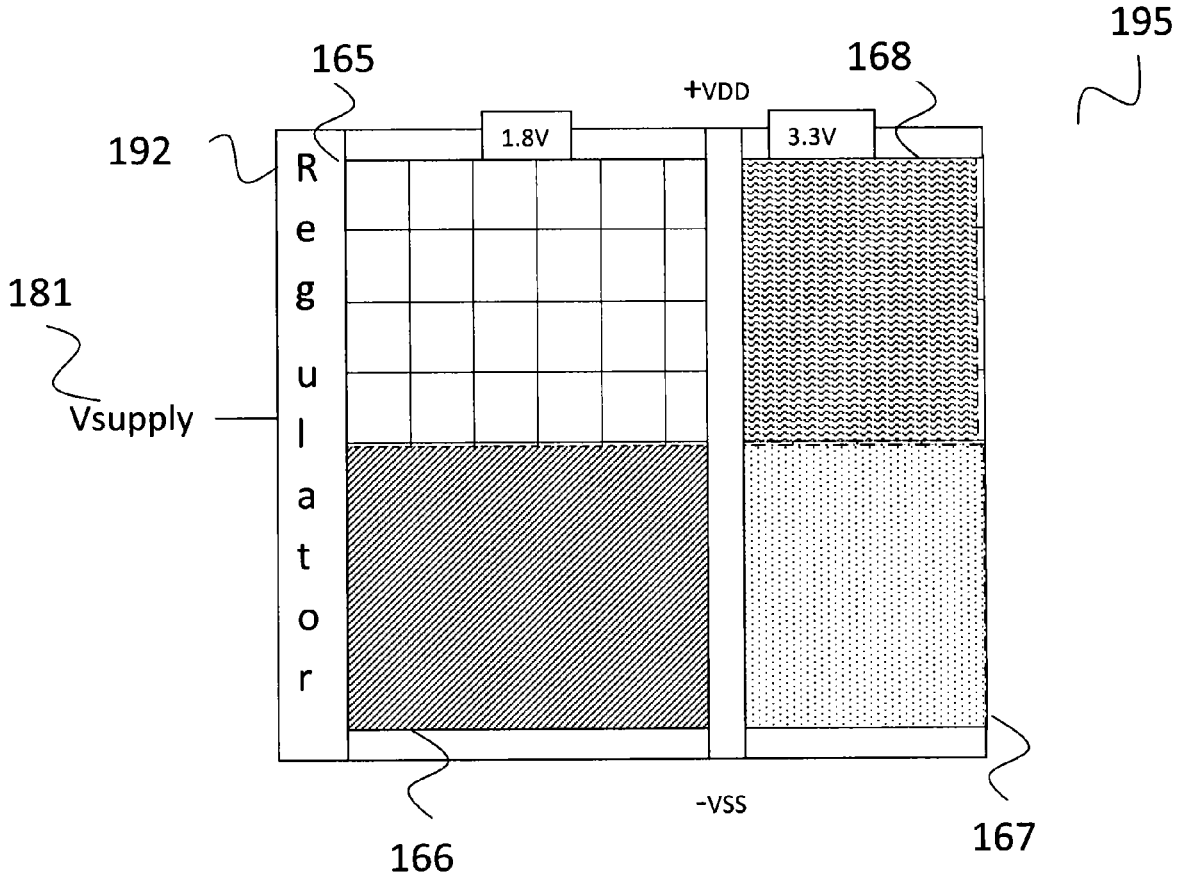
FIG. 1 Prior Art
FIG. 1 illustrates generally a block diagram example of an integrated circuit (IC) layout.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

FIG. 1 generally shows various aspects of a typical integrated circuit (IC) 195, which includes a variety of groups of circuits in IC portions that operate independently to perform functions of IC 195. For exam if IC 195 were adapted to operate a modern mobile telephone, IC portion 165 might interface with a memory device, IC portion 166 might operate a digital media player, IC portion 167 could operate a camera, and IC portion 168 may enable wireless connectivity such as Wi-Fi or Bluetooth.

Each of IC portions 165-168 will likely have unique power requirements. They may draw different levels of current (for example based on a number of transistors), require different voltage levels or operate at different frequencies. As previously mentioned, groups of circuits may frequently transition from a powered to a no or low power state and back. In order for circuits of IC 195 to operate properly, a stable power supply must be maintained in light of varying levels of current drawn from the power supply. Thus, IC 195 further includes voltage regulator circuit 192, which is adapted to receive a supply voltage 181 from a power supply such as a battery, and provide a stable supply voltage to circuits of IC 195 under varying load conditions.

Figure 2:
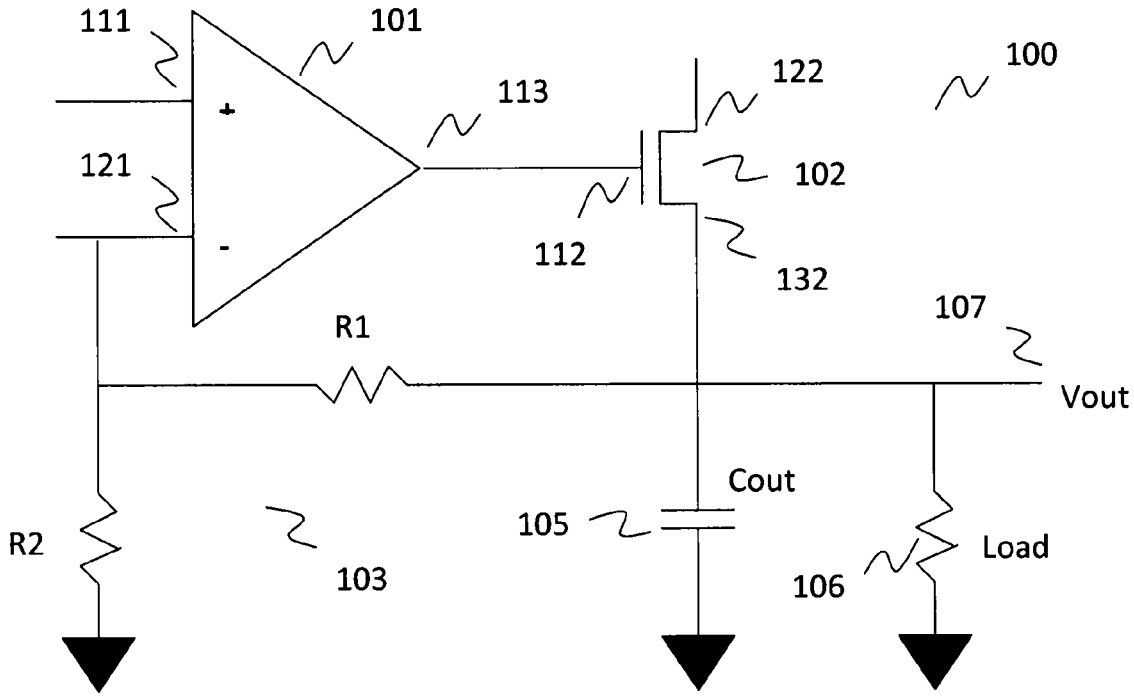
FIG. 2 Prior Art
FIG. 2 illustrates generally for exemplary purposes a schematic diagram of a known NMOS source follower circuit.

FIG. 2 shows a circuit diagram of an NMOS source follower 100. Source follower 100 includes a pass transistor 102 coupled to a feedback circuit that includes differential amplifier 101 and voltage divider 103. The feedback circuit is arranged so that an output 113 of differential amplifier 101 drives gate 112 of pass transistor 102 in response to a comparison of a voltage at output node 107 and a reference voltage at node 111 of differential amplifier 101. Due to this feedback arrangement, source follower 100 is operative to drive current to load 106 such that a voltage at output node 107 is maintained at a constant level.

Because of this feedback arrangement, source follower 100 is operable to respond to swings in output voltage due to changing load conditions and provide a stable voltage to load 106. However, the ability of source follower 100 to track a voltage is dependent on the size of capacitor 105 across load 106. For many ICs, a larger capacitor is required to ensure enough charge is present to effectively track a voltage at output 107. For purposes of the present invention, a larger capacitor is typically a capacitor or capacitor arrangement having an effective capacitance of at least 30 pico-farads. Such larger capacitors are particularly undesirable due to considerations of size and complexity of implementation. For example, a larger capacitor may add 20-30% in area consumed by a traditional voltage regulator integrated in an IC. In addition, source follower 100 is ineffective at regulating a voltage for circuits operating at certain frequencies, such as below 100 kHz.

As discussed above, many solutions have been provided to regulate a power supply voltage. The instant inventors have recognized a need for improvements allowing for effective power supply regulation under varying load conditions at a wide range of frequencies, while at the same time taking up a minimum amount of space on an IC. In addition, the instant inventors have recognized a need for a regulator circuit that effectively regulates a power supply while minimizing the need for a large output capacitor.

Figure 3:
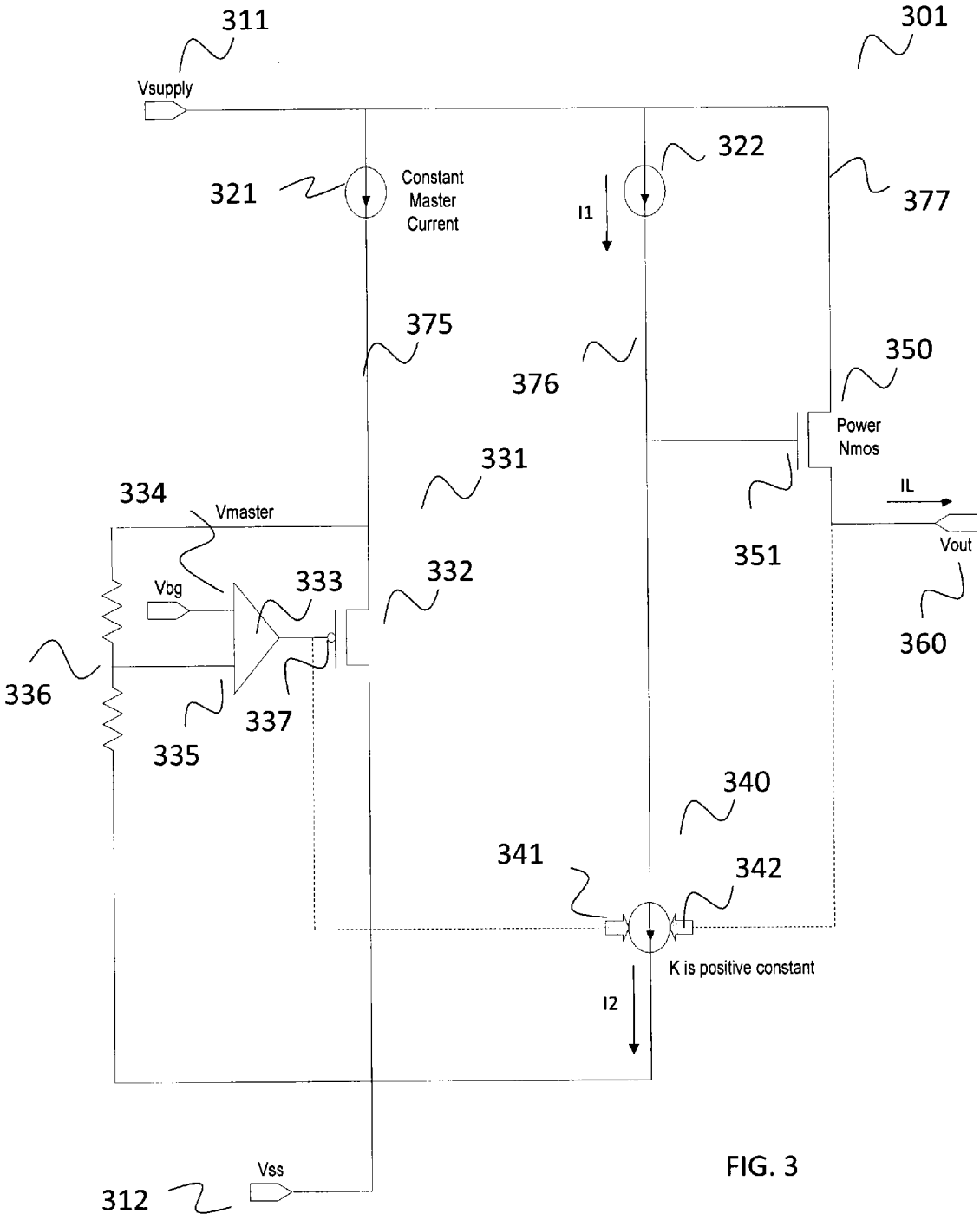
FIG. 3 illustrates generally a functional schematic diagram of one embodiment of a regulator according to various aspects of the invention described herein.

FIG. 3 illustrates generally a high-level circuit diagram of one embodiment of a power supply regulator circuit 301 according to various aspects of the invention described herein. Regulator 301 is generally constructed to receive as input a power supply that includes a positive terminal 311 and a negative terminal (ground) 312, and is adapted to supply a regulated voltage to a load at output node 360.

Regulator 301 includes feedback circuit 331 coupled to first current path 375. Feedback circuit 331 includes a differential amplifier 333 and a feedback transistor 332. In the embodiment shown, feedback transistor 332 is a Pmos transistor. Feedback circuit 331 is arranged such that a voltage at gate 337 is maintained substantially constant.

Regulator 301 also includes pass transistor 350. As shown, pass transistor 350 includes a gate 351 coupled to a second current path 376. Regulator 301 also includes first current source 322 and second current source 340. In an embodiment, first current source 322 is adapted to supply a first current I1 to second current path 376, and second current source 340 is adapted to supply a second current I2 to second current path 376. Pass transistor 350 is adapted to receive, at pass transistor gate 351, a signal based on a current of second current path 376.

In an embodiment, a magnitude of the current of second current path 376 is based on a magnitude of the first current I1 and the second current I2. Pass transistor 350 may be adapted to supply, to a load coupled to output 360, a load current with a magnitude based on the signal received at pass transistor gate 351.

In an embodiment, the signal received at pass transistor gate 351 may vary at least in part based on a current of second current path 376. The signal received at pass transistor gate 351 may be a voltage. A difference between first current I1 and second current I2 may cause changes in the voltage at pass transistor gate 351. A difference between first current I1 and second current I2 may cause a charge or discharge of the voltage at pass transistor gate 351.

A voltage at pass transistor gate 351 may have a magnitude that varies based in part on a current of second current path 376 and a parasitic resistance of first current source 322 and second current source 340. In an embodiment, the parasitic resistance of first current source 322 and second current source 340 may be a parasitic resistance between a drain and source of at least one transistor of first current source 322 and/or second current source 340. A change in a voltage at pass transistor gate 351 may cause a change in a magnitude of a current supplied to a load coupled to output 360.

In the embodiment shown, first current source 322 functions to pull up a current supplied to second current path 376 (increase a level of current supplied to second current path 376), while second current source 340 is operative to pull down a current supplied to gate 351 (reduce a level of current supplied to second current path 376). As shown, first current source 322 and second current source 340 are arranged to supply current to a single current path, second current path 376.

In the embodiment of FIG. 3, first current source 322 is a constant current source adapted to mirror a current of master current source 321 to supply, to second current path 376, a current I1 based on a current of first current path 375. In an alternative embodiment, first current source 322 is an independent current source constructed to receive as input a bias voltage and supply a first current I1 with a magnitude based on the bias voltage.

In the depicted embodiment, second current source 340 is a variable current source adapted to supply a current to second current path 376 with a magnitude based on first reference signal 341 and second reference signal 342. In one embodiment, first reference signal 341 is based on a voltage at feedback transistor gate 337, and second reference signal 341 is based on a voltage at output node 360.

In an embodiment, second current source 340 is adapted to supply a second current according to the equation $I=K(Vout-Vgate-Vt)^2$, where Vout is a voltage at output node 360, Vgate is a voltage at feedback transistor gate 337, Vt is a threshold voltage of a at least one transistor of second current source 340, and K is a positive constant. In an embodiment, second current source 340 is adapted to supply a second current according to the equation $I=K(Vout-Vgate-Vt)^{2*}(1+\gamma(Vdrain-Vsource))$, where Vdrain is a drain voltage and Vsource is a source voltage, respectively, of at least one transistor of second current source 340, and $\gamma$ is a positive parameter. In an embodiment, $\gamma$ is a parameter at least in part based on transistor attributes, such as channel width and/or length.

Regulator 301 may be adapted to operate such that when a voltage at output node 360 decreases (indicating that a current drawn by the load has increased, or additional circuitry has been turned on), second current source 340 is adapted to decrease a magnitude of current supplied to second current path 376, resulting in an increase in a voltage at pass device gate 351, thus causing pass device 350 to increase a magnitude of current supplied to a load coupled to output node 360. Likewise, when a voltage at output node 360 increases, second current source 340 is adapted to increase a magnitude of current supplied to second current path 376, resulting in a decrease in a voltage at pass device gate 351, thus causing pass device 350 to decrease a magnitude of current supplied to output node 360.

The circuit arrangement of regulator 301 is advantageous, because second current source 340 is able to provide a precise comparison between a stable voltage at feedback transistor 331 and a voltage across a load at output 360. Regulator 301 is further advantageous, because it is constructed to regulate a supply voltage for circuits operating at both low and high frequencies.

Figure 4:
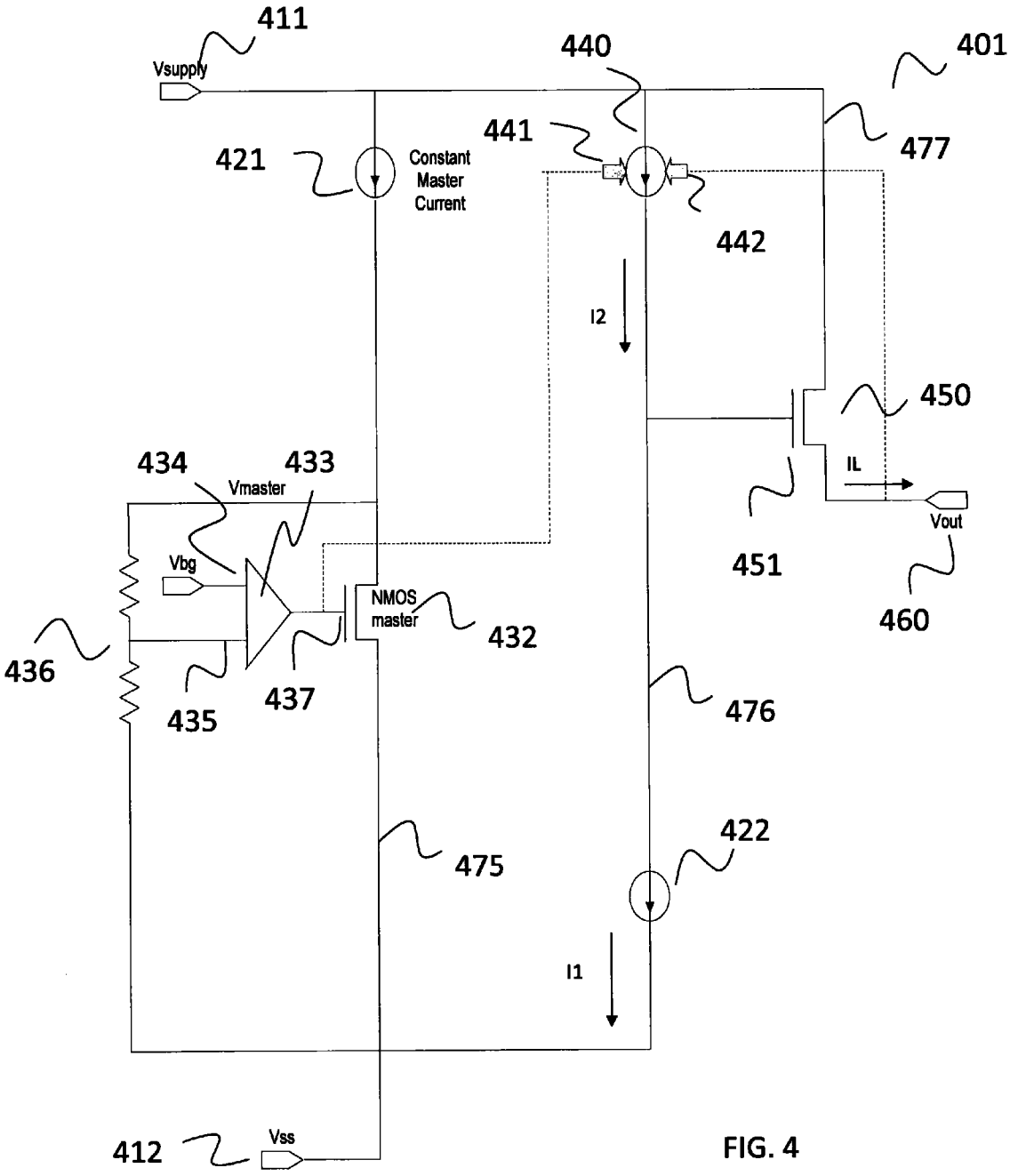
FIG. 4 illustrates generally a functional schematic diagram of an alternative embodiment of a regulator according to various aspects of the invention described herein.

FIG. 4 illustrates generally a high-level circuit diagram of an alternative embodiment of a power supply regulator circuit 401. The regulator of FIG. 4 is similar to the regulator depicted in FIG. 3, except feedback transistor 401 is an NMOS transistor instead of a PMOS transistor.

Regulator 401 includes first current source 422 and second current source 440. In an embodiment, first current source 422 is adapted to supply a first current I1 to second current path 476, and second current source 440 is adapted to supply a second current I2 to second current path 476.

As shown, regulator 401 further includes pass transistor 450. Pass transistor 450 may be is adapted to receive, at pass transistor gate 451, a signal based on a current of second current path 476. In an embodiment, a magnitude of the current of second current path 476 is based on a magnitude of the first current I1 and the second current I2. Pass transistor 450 may be adapted to supply, to a load coupled to output 460, a load current with a magnitude based on the signal received at pass transistor gate 451.

In an embodiment, the signal received at pass transistor gate 451 may vary at least in part based on a current of second current path 476. The signal received at pass transistor gate 451 may be a voltage. A difference between first current I1 and second current I2 may cause changes in a voltage at pass transistor gate 451. A difference between first current I1 and second current I2 may cause a charge or discharge of a voltage at pass transistor gate 451.

A voltage at pass transistor gate 451 may have a magnitude that varies based in part on a current of second current path 476 and a parasitic resistance of first current source 422 and second current source 440. In an embodiment, the parasitic resistance of first current source 422 and second current source 440 may be a parasitic resistance between a drain and source of at least one transistor of first current source 422 and/or second current source 440.

First current source 422 may be a constant current source adapted to supply, to second current path 476, a first current I1 with a substantially constant magnitude. In one embodiment, first current source 422 is a slave of a current mirror. According to this embodiment, first current source 422 is constructed to mirror a current of master current source 421. In an alternative embodiment, first current source 422 is adapted to receive as input a bias voltage and supply a first current I1 to second current path 476 with a magnitude based on a magnitude of the bias voltage.

Second current source 440 may be adapted to supply, to second current path 476, a variable current. In an embodiment, second current source 440 is adapted to receive a first reference signal 441 and a second reference signal 442, and supply a second current I2 with a magnitude based on first reference signal 441 and second reference signal 442. In an embodiment, first reference signal 441 is a voltage at gate 437 of feedback transistor 431, and second reference signal 442 is a voltage at output node 460.

In an embodiment, second current source 440 is adapted to supply a second current according to the equation $I=K(Vgate-Vout-Vt)^2$, where Vout is a voltage at output node 460, Vgate is a voltage at feedback transistor gate 437, Vt is a threshold voltage of at least one transistor of second current source 440, and K is a positive constant. In an embodiment, second current source 340 is adapted to supply a second current according to the equation $I=K(Vgate-Vout-Vt)^{2*}(1+\gamma(Vdrain-Vsource))$, where Vdrain is a drain voltage and Vsource is a source voltage, respectively, of at least one transistor of second current source 340, and $\gamma$ is a positive parameter. In an embodiment, $\gamma$ is a parameter at least in part based on transistor attributes, such as channel width and/or length.

According to the embodiment shown, second current source 440 is operable to pull up a current supplied to gate 451 of pass transistor 450, and first current source 422 is operable to pull down a current supplied to pass transistor gate 451.

In an embodiment, regulator 401 is adapted to operate such that when a voltage at output node 460 decreases (indicating that a current drawn by the load has increased, possibly caused by circuitry of the load that has been turned on), second current source 440 is adapted to increase a magnitude of current supplied to second current path 476, resulting in an increase in a signal at pass device gate 451, thus increasing a magnitude of current supplied to output node 460. Likewise, when a voltage at output node 460 increases, second current source 440 is adapted to decrease a magnitude of current supplied to second current path 476, resulting in a decrease of a signal supplied to pass device gate 451, thus causing a decrease in a magnitude of current supplied to output node 460.

Both of the embodiments depicted in FIGS. 3 and 4 provide an advantage over other known voltage regulators in that they are adapted to control the supply of a relatively large load source current (for example milli-amps, or less than one amp) via feedback signals of relatively small currents (for example micro-amps, or less than one milli-amp). In addition, regulators 301 and 401 are advantageous because they supply a load source current via a single current path, current paths 377 and 477, respectively, thus reducing power consumption compared to other known regulators.

Figure 5:
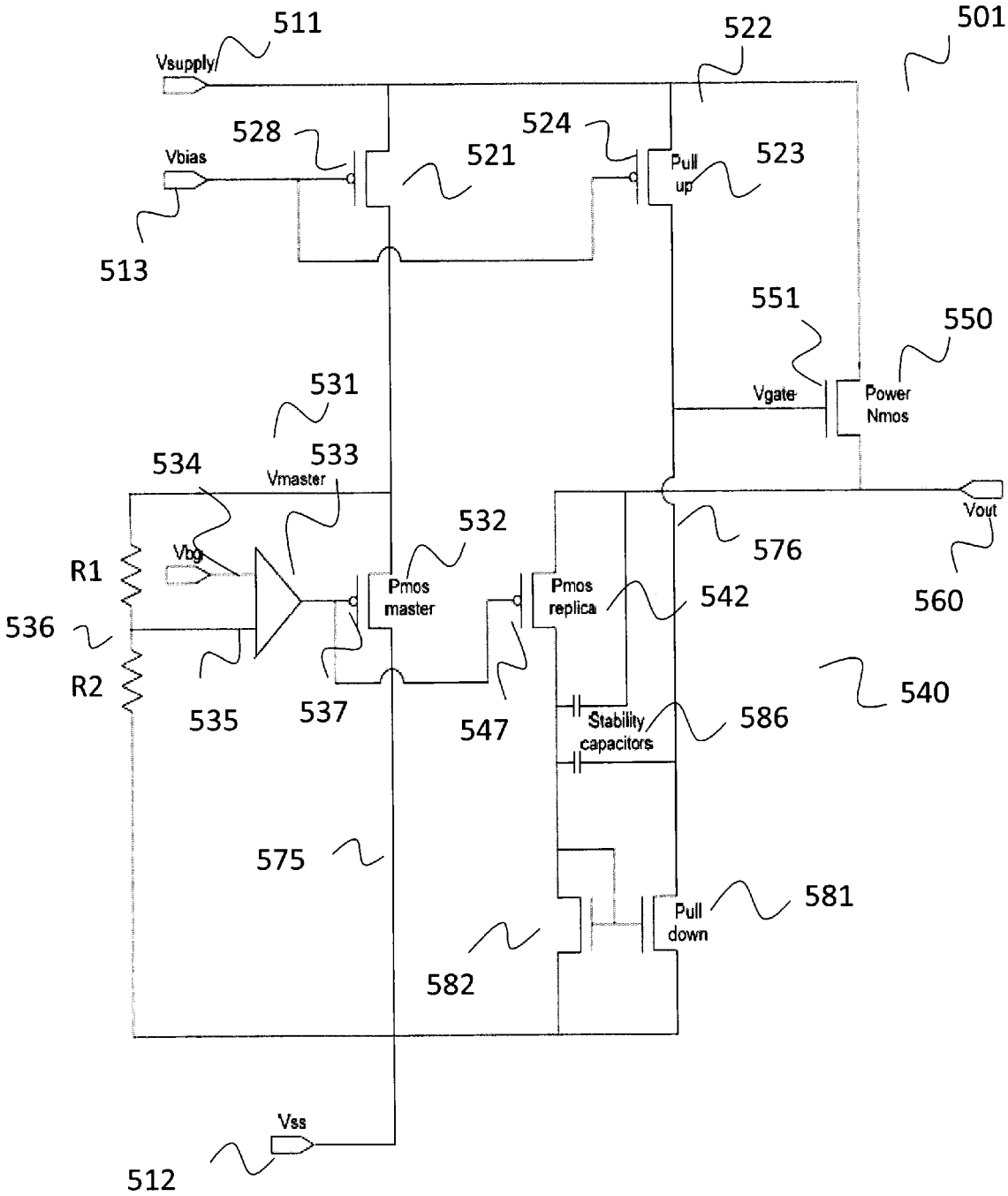
FIG. 5 illustrates generally a schematic diagram of one embodiment of a regulator according to various aspects of the invention described herein.

FIG. 5 illustrates generally a circuit diagram of one embodiment of regulator circuit 301. As shown in FIG. 3, regulator circuit 501 includes feedback circuit 531. Feedback circuit 531 is operative to maintain a voltage at a gate of feedback transistor 532 substantially constant. To do so, feedback circuit 531 includes differential amplifier 533 and voltage divider 536. Differential amplifier 533 is adapted to receive, at input 535, a feedback voltage proportional to a voltage across the drain and source terminals of feedback transistor 532, and compare the feedback voltage to a reference voltage received at input terminal 534. In one embodiment, the reference voltage is a band gap voltage. In operation, differential amplifier 533 is operable to drive a gate of feedback transistor 532 to maintain a voltage at feedback transistor gate 537 substantially constant.

The embodiment of FIG. 5 also shows one embodiment of first current source 522. First current source 522 may be adapted to supply a substantially constant current. In the depicted embodiment, first current source 522 is a slave transistor 523 of a current mirror. Gate 524 of transistor 523 is electrically coupled to gate 528 of master transistor 521. Master transistor 521 is adapted to receive at gate 528 a bias voltage. As arranged, both master transistor 521 and slave transistor 522 are constructed to supply a substantially constant current based on a magnitude of the bias voltage at gate 528. In an embodiment, the arrangement of transistors 521 and 522 as a current mirror is operative to supply, to current path 576 via slave transistor 522, a first current based on a current of first current path 575. In an embodiment, the first current is a substantially constant current.

FIG. 5 further illustrates one embodiment of a second current source such as current source 340 illustrated in FIG. 3. In various embodiments, second current source 540 is a variable current source adapted to supply a second current to second current path 576. As depicted, second current source 540 includes replica transistor 542 that includes a gate 547 coupled to feedback transistor 532 gate 537. As shown, replica transistor 542 also includes a drain coupled to output node 560. According to this arrangement, a voltage between the gate and source of replica transistor 542 is equivalent to a voltage at feedback transistor gate 537 subtracted from a voltage at output 560.

In an embodiment, replica transistor 542 is operated in a saturation region. A basic equation for the current through a MOS transistor in saturation is $I=K(Vgs-Vt)^2$. Thus, replica transistor 542 is adapted to supply current based on a comparison of Vout and Vgate: $I=K(Vout-Vgate-Vt)^2$, where Vout is a voltage at output 560, Vgate is a voltage at feedback transistor gate 537, and Vt is a threshold voltage of replica transistor 542. In various embodiments, K is a positive constant. In some embodiments, K is a positive constant based on transistor process variables. In one such embodiment, K is a positive constant based on transistor width and length for replica transistor 542. In an embodiment, replica transistor 542 is adapted to supply a second current according to the equation $I=K(Vout-Vgate-Vt)^{2*}(1+\gamma(Vdrain-Vsource))$, where Vdrain is a drain voltage and Vsource is a source voltage, respectively, of replica transistor 542, and $\gamma$ is a positive parameter. In an embodiment, $\gamma$ is a parameter at least in part based on replica transistor 542 attributes, such as channel width and/or length.

In the embodiment shown, second current source 540 also includes transistors 581 and 582. Transistors 581 and 582 are connected such that a current of replica transistor 542 is mirrored at pull down transistor 581, thus pulling down a current through second current path 576. Also shown is an embodiment wherein second current source 540 includes stability capacitor arrangement 586, which is constructed to store charge so as to ensure replicator transistor 542 can supply current quickly in response to changes in output voltage levels. In various embodiments, stability capacitor arrangement 586 has a capacitance in the range of 5-30 pico-farads. In contrast, known voltage regulators such as nmos source follower 100 typically employ a capacitor arrangement with a larger capacitance, such as greater than 30 pico-farads.

In various embodiments a signal at pass transistor gate 551, such as a voltage, has a magnitude based on a current of second current path 576. In an embodiment, the current of second current path 576 is dependent on the first and second currents supplied by first current source 522 and second current source 540. A voltage at pass transistor gate 551 may vary based on the first and second currents and a parasitic resistance of first current source 522 and second current source 540.

In operation, first current source 522 operates to supply a consistent level of current to second current path 576. This current is "pulled down" by second current source 540 to maintain a relative equilibrium of a current of second current path 576. However, should a load coupled to output node 560 increase in magnitude resulting in a voltage drop at output 560, this drop will result in a decrease in current "pulled" by variable current source 540, and thus cause an increase in a voltage at pass transistor gate 551. Likewise, if a voltage at output 560 increases, indicating a reduction in output load, more current is caused to be "pulled" through second current source 540, and thus cause a decrease in a voltage at pass transistor gate 551.

Figure 6:
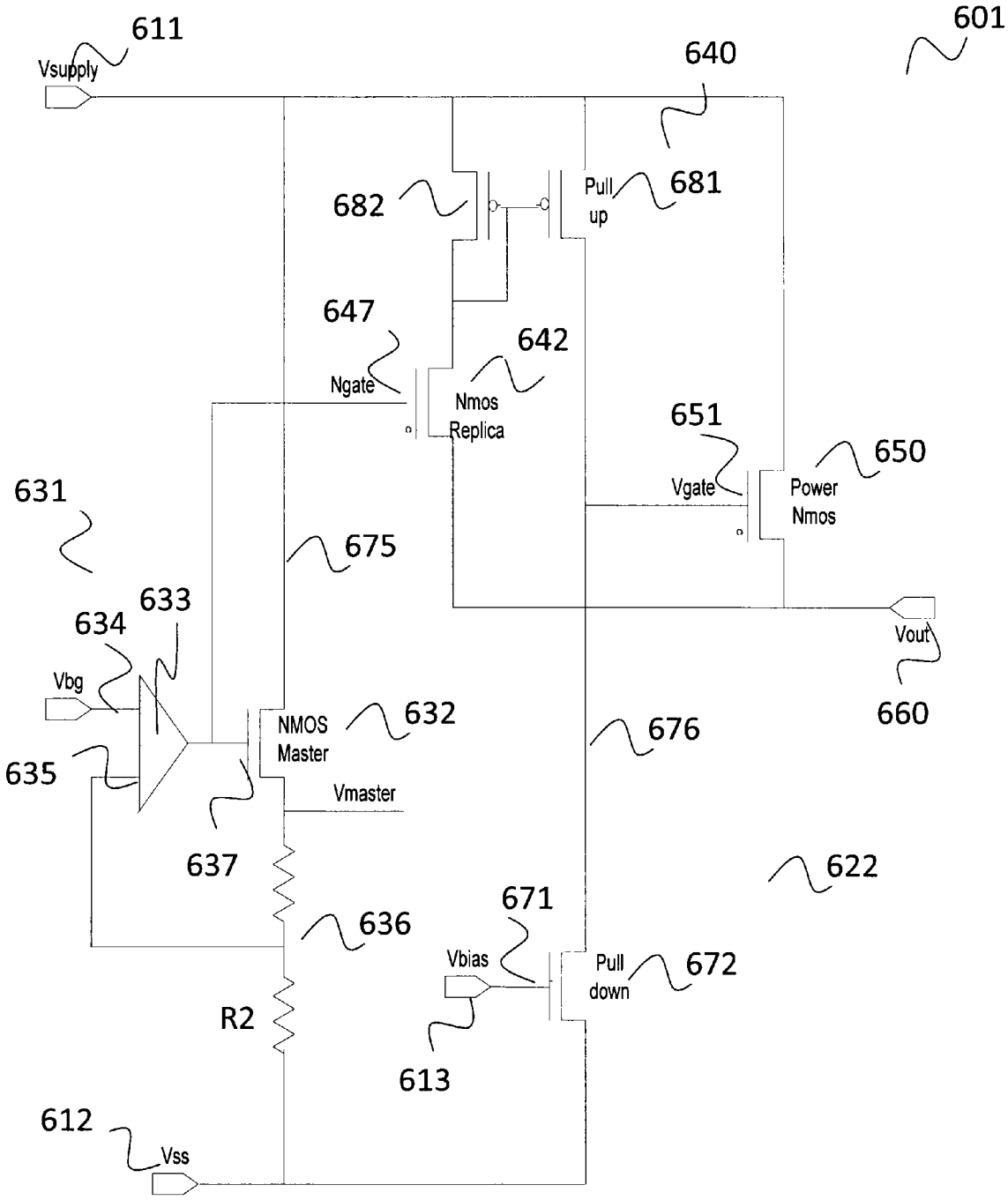
FIG. 6 illustrates generally a schematic diagram of an alternative embodiment of a regulator according to various aspects of the invention described herein.

FIG. 6 illustrates generally a circuit diagram of one embodiment of regulator circuit 401 of FIG. 4 that utilizes an NMOS replica transistor instead of PMOS as shown in FIGS. 3 and 5. Regulator circuit 601 operates according to similar principles as regulator circuit 501, with feedback circuit 631 supplying a substantially constant voltage at gate 647 of feedback transistor 632. As shown, replica transistor gate 647 is coupled to feedback transistor gate 631. According to this arrangement, a voltage at gate 647 of replica transistor 642 is based on a voltage at gate 637 of feedback circuit 631 and a voltage at output 660.

In an embodiment, replica transistor 642 is constantly operated in a saturation region. A basic equation for the current through a MOS transistor in saturation is $I=K(Vgs-Vt)^2$. Thus, replica transistor is adapted to supply current based on a comparison of Vout and Vgate: $I=K(Vgate-Vout-Vt)^2$, where Vout is a voltage at output 660, Vgate is a voltage at replica transistor gate 647, and Vt is a threshold voltage of replica transistor 642. In various embodiments, K is a positive constant. In some embodiments, K is a positive constant based on transistor process variables. In one such embodiment, K is a positive constant based on transistor width and length for replica transistor 642. In an embodiment, replica transistor 642 is adapted to supply a second current according to the equation $I=K(Vgate-Vout-Vt)^{2*}(1+\gamma(Vsource-Vdrain))$, where Vdrain is a drain voltage and Vsource is a source voltage, respectively, of replica transistor 642, and $\gamma$ is a positive parameter. In an embodiment, $\gamma$ is a parameter at least in part based on replica transistor 642 attributes, such as channel width and/or length.

In the embodiment shown, second current source 640 also includes transistors 681 and 682. These transistors are arranged such that a current of replica transistor 642 is mirrored at transistor 681, supplying current to second current path 676. In an embodiment (not shown in FIG. 6), second current source 640 further includes stability capacitors constructed to store charge so as to ensure replicator transistor 642 can supply current quickly in response to changes in output voltage levels. In various embodiments, the stability capacitor arrangement has a capacitance in the range of 5-30 pico-farads. In contrast, known voltage regulators such as nmos source follower 100 typically employ a capacitor arrangement with a larger capacitance, such as greater than 30 pico-farads.

In various embodiments a signal at pass transistor gate 651, such as a voltage, has a magnitude based on a current of second current path 676. In an embodiment, the current of second current path 676 is dependent on the first and second currents supplied by first current source 622 and second current source 640. A voltage at pass transistor gate 651 may vary based on the first and second currents and a parasitic resistance of first current source 622 and second current source 640.

In operation, first current source 622 operates to supply a consistent level of pull down current to second current path 676. In the embodiment shown, a bias voltage is applied to gate 671 of transistor 672, which functions to supply a constant current dependent on the bias voltage. In an alternative embodiment not shown in FIG. 6, second current source 622 is a slave transistor of a current mirror, and is adapted to mirror a current of first current path 675.

In the embodiment shown, the first current supplied by first current source 622 is "pulled up" by second current source 640 to maintain a relative equilibrium of a current of second current path 676. However, should current drawn by a load coupled to output node 660 increase in magnitude resulting in a voltage drop at output 660, this drop will result in an increase in current supplied by replica transistor 642 and thus cause an increase in a voltage at pass transistor gate 651. Likewise, if a voltage at output 660 increases, indicating a reduction in output load, less current is caused to be supplied to second current path 676, thus causing a decrease in a voltage at pass transistor gate 651.

Figure 7:
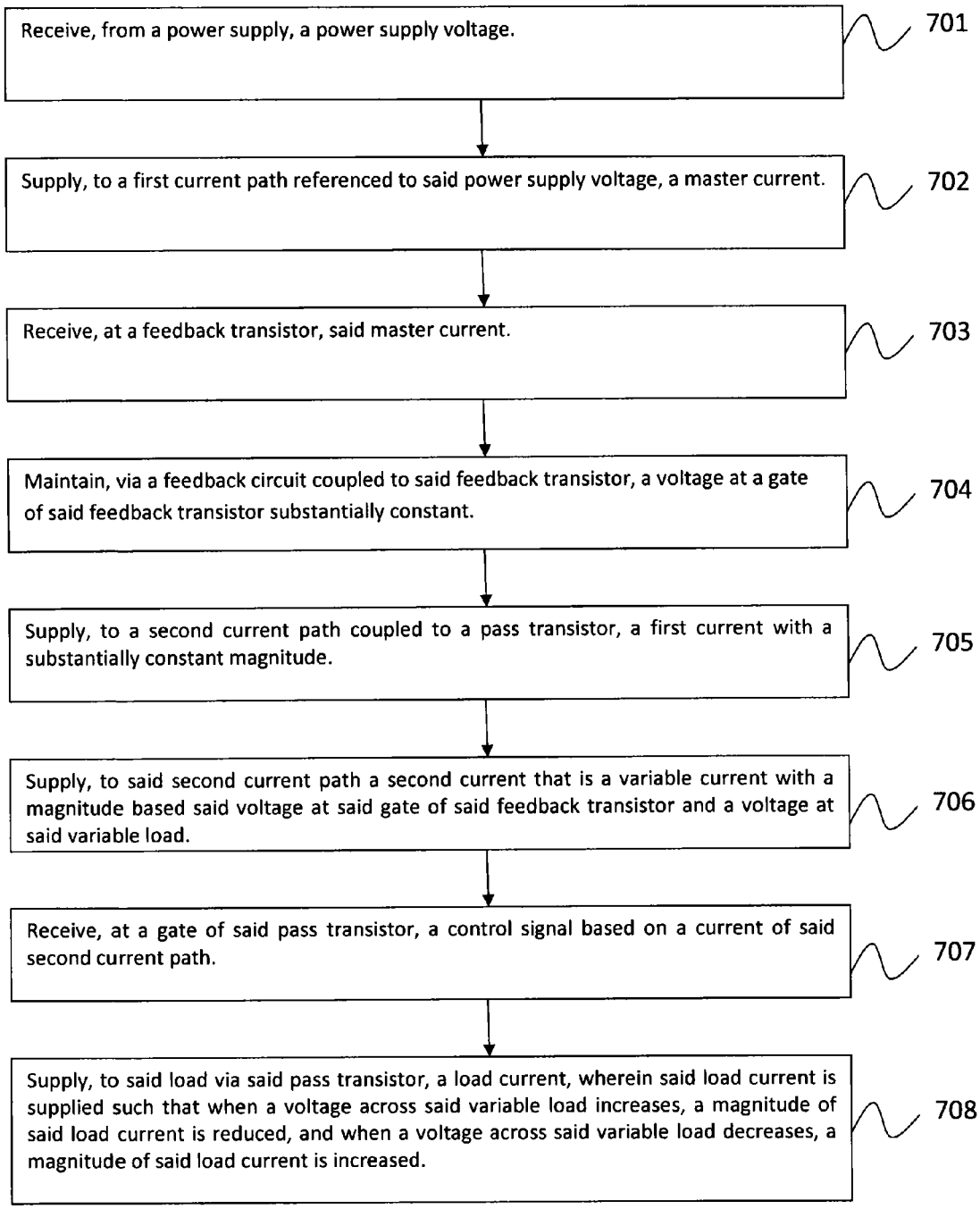
FIG. 7 illustrates generally one embodiment of a method of regulating a supply voltage under variable load conditions according to various aspects of the invention described herein.

FIG. 7 illustrates generally a flow chart of one embodiment of a method of regulating a supply voltage. At 701, a power supply voltage is received from a power supply. At 702, a master current is supplied to a first current path referenced to the power supply voltage. At 703, the master current is received at a feedback transistor. At 704, a voltage at a gate of the feedback transistor is maintained substantially constant via a feedback circuit coupled to the feedback transistor. At 705, a first current with a substantially constant magnitude is supplied to a second current path coupled to a pass transistor. At 706, a second current is supplied that is a variable current with a magnitude based on the voltage at the gate of said feedback transistor and a voltage at the variable load. At 707, a signal based on current of the second current path is received at a gate of said pass transistor. At 708, a load current is supplied to the load via the pass transistor. In an embodiment, the load current is supplied such that when a voltage across the variable load increases, a magnitude of the load current is reduced, and when a voltage across said variable load decreases, a magnitude of the load current is increased.

Figure 8:
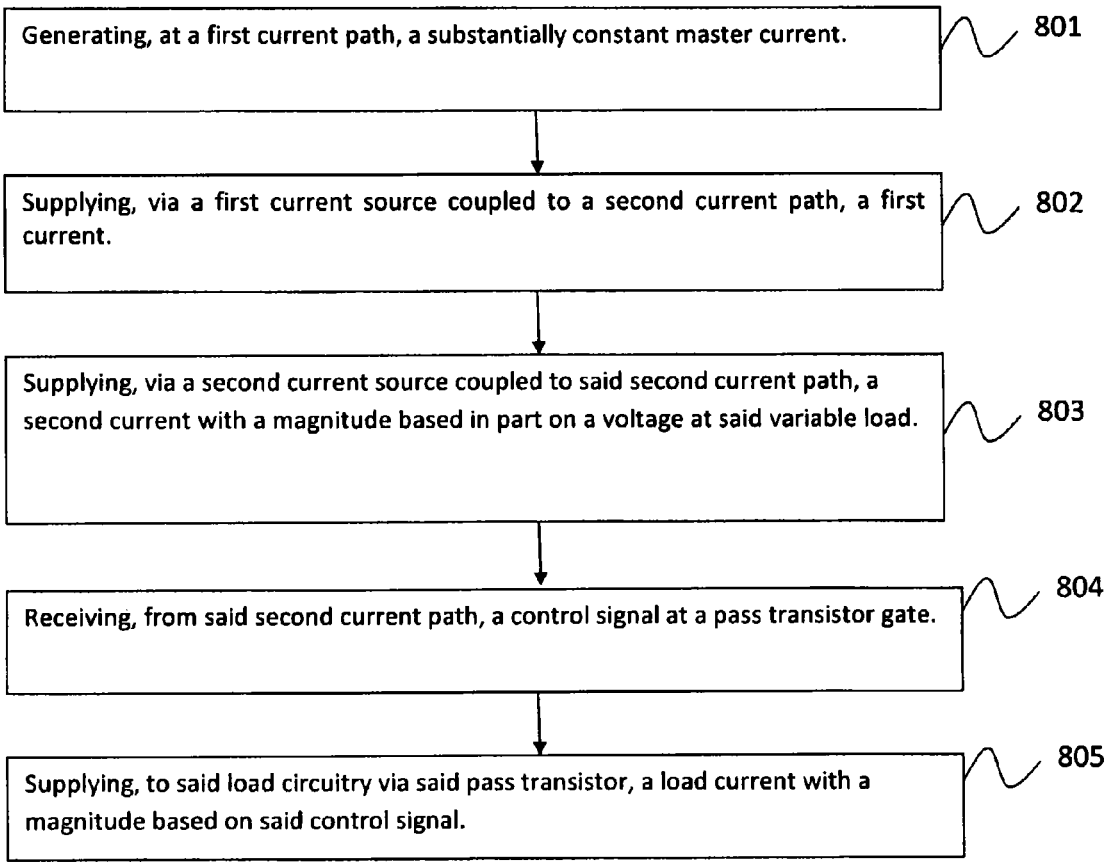
FIG. 8 illustrates generally one embodiment of a method of regulating a supply voltage under variable load conditions according to various aspects of the invention described herein.

FIG. 8 illustrates generally one embodiment of a method of regulating a supply voltage for selectively operable load circuitry of an integrated circuit. At 801, a substantially constant master current is generated at a first current path. At 802, a first current is supplied to a second current path via a first current source. At 803, a second current is supplied to the second current path via a second current source. In an embodiment, the second current has a magnitude based in part on a voltage at the selectively operable load circuitry. In an embodiment, a magnitude of the first current and a magnitude of the second current are dependent on a magnitude of the master current. At 804, a control signal is received at a pass transistor gate with a magnitude based on the first and second currents. At 805, a load current is supplied to the load circuitry based on a magnitude of the control signal.

Various embodiments of systems, devices and methods have been described herein. These embodiments are given only by way of example and are not intended to limit the scope of the present invention. It should be appreciated, moreover, that the various features of the embodiments that have been described may be combined in various ways to produce numerous additional embodiments. Moreover, while various materials, dimensions, shapes, implantation locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A voltage regulator circuit integrated in an integrated circuit (IC) and adapted to provide a voltage from a power supply to a load under varying load conditions, comprising:

an input adapted to receive a voltage from said power supply;

an output adapted to be coupled to said load;

a feedback circuit coupled to a first current path and including a feedback transistor, wherein said feedback circuit is constructed to maintain a voltage at a gate of said feedback transistor substantially constant;

a first current supply circuit constructed to supply to a second current path a first current that is substantially constant;

a second current supply circuit coupled to said first current supply circuit, said gate of said feedback transistor, and said output of said voltage regulator circuit and constructed to supply a second current to said second current path with a magnitude based on said voltage at said gate of said feedback transistor and a voltage at said output of said voltage regulator circuit;

a pass device including a gate coupled to said second current path and adapted to receive a signal based on said current of said second current path and supply a load current to said load via said output of said voltage regulator circuit with a magnitude based on said signal;

wherein said second current supply circuit is adapted to, via said pass device, cause an increase in magnitude of said load current supplied to said output if a voltage at said output decreases and cause a decrease in magnitude of said load current supplied to said output if a voltage at said output increases; and wherein said feedback circuit, said first current supply circuit, said second current supply circuit, and said pass device are integrated in an integrated circuit and referenced to said input of said voltage regulator circuit.

2. The voltage regulator circuit of claim 1, wherein said second current supply circuit includes a replica transistor that includes a gate coupled to said gate of said feedback transistor, wherein a voltage at said gate of said replica transistor is based on a difference between a voltage at said gate of said feedback transistor and a voltage at said output of said voltage regulator circuit, and wherein said second current supply circuit is adapted to supply said second current with a magnitude based on said voltage at said gate of said replica transistor.

3. The voltage regulator circuit of claim 2, wherein said replica transistor is an nmos transistor.

4. The voltage regulator circuit of claim 2, wherein said second current supply circuit is constructed to supply said second current based on $K(Vgate-Vout-Vth)^2$, wherein Vout is said voltage at said output of said voltage regulator circuit, Vgate is said voltage at said gate of said feedback transistor, and Vth is a threshold voltage of said replica transistor, and K is a positive constant.

5. The voltage regulator circuit of claim 2, wherein said replica transistor is a pmos transistor.

6. The voltage regulator circuit of claim 2, wherein said second current supply circuit is constructed to supply said second current based on $K(Vout-Vgate-Vth)^2$, wherein Vout is said voltage at said output of said voltage regulator circuit, Vgate is said voltage at said gate of said feedback transistor, and Vth is a threshold voltage of said replica transistor, and K is a positive constant.

7. The voltage regulator circuit of claim 1, wherein said second current supply circuit further comprises at least one stability capacitor arrangement.

8. The voltage regulator circuit of claim 7, wherein said at least one stability capacitor arrangement has a capacitance of less than 30 pico-farads.

9. The voltage regulator of claim 1, wherein said load current has a magnitude that is at least one order of magnitude greater than a magnitude of a current of said second current path.

10. The voltage regulator of claim 1, wherein said load current has a magnitude of less than one amp, and wherein said current of said second current path has a magnitude of less than one milli-amp.

11. The voltage regulator of claim 1, wherein said signal received at said pass device gate is a voltage.

12. A voltage regulator circuit integrated in an integrated circuit (IC) and adapted to provide a voltage from a power supply to a load under varying load conditions, comprising:

an input adapted to receive a voltage from said power supply, wherein said input includes a positive node and a negative node;

an output adapted to be coupled to said load;

a current mirror that includes a first transistor coupled to a first current path that includes a gate constructed to receive a bias voltage and a first end coupled to said positive node;

a second transistor coupled to a second current path that includes a gate coupled to said gate of said first transistor; and wherein said current mirror is operable to mirror a current of said first current path at said second current path;

a feedback circuit coupled to said first current path that includes:

a differential amplifier that includes a first input, a second input, and an output, wherein said differential amplifier is adapted to provide, at said output, an output voltage based on a difference between a voltage at said first input and a voltage at said second input, and wherein said first input is constructed to receive a reference voltage;

a feedback transistor that includes a gate, a first end, and a second end, wherein said first end is coupled to a second end of said first transistor of said current mirror, and wherein said second end is coupled to said negative node;

a voltage divider that includes a first end coupled to said second end of said first transistor of said current mirror and a second end coupled to said negative node;

wherein said second input of said differential amplifier is coupled to said voltage divider such that a voltage at said second input is based on a voltage across said first end and said second end of said feedback transistor, wherein said gate of said feedback transistor is coupled to said output of said differential amplifier; and wherein said differential amplifier, said feedback transistor, and said voltage divider are constructed and arranged such that a voltage at said gate of said feedback transistor is maintained at a substantially constant magnitude;

a current source that includes a first end coupled to a second end of said second transistor of said current mirror and a second end coupled to said negative node, and wherein said current source is constructed to receive a first voltage reference based on a voltage at said gate of said feedback transistor and a second voltage reference based on a voltage at said output of said voltage regulator circuit and supply a second current to said second current path with a magnitude based on said first voltage reference and said second voltage reference;

a pass device that includes a first end coupled to said positive node, a second end constructed to be coupled to said load at said output of said voltage regulator circuit, and a gate coupled to said second end of said second transistor of said current mirror and said first end of said current source, wherein said gate of said pass device is adapted to receive a signal based on a magnitude of a current of said second current path;

wherein said current source is constructed to, if said second voltage reference increases in magnitude, cause a decrease said signal received at said gate of said pass device, and if said second voltage reference decreases in magnitude, cause an increase in a magnitude of said signal received at said gate of said pass device;

wherein said pass device is constructed to supply a load current to a load coupled to said output of said voltage regulator circuit with a magnitude based on said signal received at said gate of said pass device; and wherein said current mirror, said feedback circuit, said current source, and said pass device are integrated in an integrated circuit.

13. The voltage regulator circuit of claim 12, wherein said current source includes a replica transistor that includes a gate coupled to said gate of said feedback transistor, wherein a voltage at said gate of said replica transistor is based on a difference between a voltage at said gate of said feedback transistor and said output of said voltage regulator circuit, and wherein said current source is adapted to supply a current with a magnitude based on said signal received at said gate of said replica transistor.

14. A voltage regulator circuit integrated in an integrated circuit (IC) and adapted to provide a voltage from a power supply to a load integrated in the IC under selectively variable load conditions, comprising:

an input adapted to receive a voltage from said power supply;

an output adapted to be coupled to said load;

a first current path referenced to said input;

feedback means for maintaining a voltage at a gate of a feedback transistor substantially constant;

first current supply means for supplying to a second current path referenced to said input a first current that is substantially constant;

second current supply means coupled to said first current supply means, said gate of said feedback transistor, and said output of said voltage regulator circuit for receiving a first voltage reference and a second voltage reference and for supplying a second current to said second current path with a magnitude based on said first voltage reference and said second voltage reference;

means for supplying current to said load for receiving a signal based on a magnitude of said first current and a magnitude of said second current and for supplying a load current to said load via said output of said voltage regulator circuit with a magnitude based on a magnitude of said signal;

wherein said first current supply means, said second current supply means and said means for supplying current to said load are arranged such that, if a voltage at said load decreases, a magnitude of said load current is increased and, if a voltage said load increases, a magnitude of said load current is decreased; and wherein said feedback means, said first current supply means, said second current supply means, and said means for supplying current to said load are integrated in an integrated circuit.

15. The voltage regulator circuit of claim 14, wherein said second current supply means includes a replica transistor that includes a gate coupled to said gate of said feedback transistor, wherein a voltage at said gate of said replica transistor is based on a difference between a voltage at said gate of said feedback transistor and a voltage at said output of said voltage regulator circuit, and wherein said second current supply means are for supplying said second current with a magnitude based on said voltage at said gate of said replica transistor.

16. A method of regulating a supply voltage for selectively operable load circuitry of an integrated circuit, comprising:

receiving, from a power supply, a power supply voltage;

supplying, to a first current path integrated in said integrated circuit and referenced to said power supply voltage, a master current;

receiving, at a feedback transistor integrated in said integrated circuit, said master current;

maintaining, via a feedback circuit integrated in said integrated circuit and coupled to said feedback transistor, a voltage at a gate of said feedback transistor substantially constant;

supplying, to a second current path integrated in said integrated circuit and coupled to a pass transistor, a first current with a substantially constant magnitude;

supplying, to said second current path, a second current that is a variable current with a magnitude based on said voltage at said gate of said feedback transistor and a voltage at said variable load;

receiving, at a gate of said pass transistor integrated in said integrated circuit, a control signal based on a magnitude of a current of the second current path; and supplying, to said load via said pass transistor, a load current based on the control signal such that when a voltage across said variable load increases, a magnitude of said load current is reduced, and when a voltage across said variable load decreases, a magnitude of said load current is increased.

17. A method of regulating a supply voltage for selectively operable load circuitry of an integrated circuit, comprising:

generating, at a first current path integrated in said integrated circuit, a substantially constant master current;

supplying, via a first current source integrated in said integrated circuit and coupled to a second current path, a first current;

supplying, via a second current source integrated in said integrated circuit and coupled to said second current path, a second current with a magnitude based in part on a voltage at said variable load;

receiving, from said second current path, a control signal at a pass transistor integrated in said integrated circuit, wherein said control signal has a magnitude based a current of said second current path;

supplying, to said load circuitry via said pass transistor, a load current in response to said control signal; and wherein a magnitude of said first current and a magnitude of said second current are at least in part dependent on a magnitude of said master current.

18. The method of claim 17, wherein supplying said second current includes supplying a current based on a difference between a voltage at a gate of a feedback transistor of a feedback circuit and a voltage at said load circuitry.

19. The method of claim 17, wherein supplying, to said load circuitry via said pass transistor, a load current includes increasing a magnitude of said load current if a voltage at said output decreases, and decreasing a magnitude of said load current if a voltage at said output increases.

20. The method of claim 17, wherein supplying said load current includes supplying a current with a magnitude of less than one amp, and wherein supplying first current and supplying said second current includes supplying a current with a magnitude of less than one milli-amp.

* * * * *